United States Patent [19]

Homes

[11] Patent Number: 4,692,981

[45] Date of Patent: Sep. 15, 1987

[54] PROCESS FOR REPLACING BRIDGE BEARINGS

[75] Inventor: Helmut Homes, Uslar, Fed. Rep. of Germany

[73] Assignee: Glacier GmbH—Sollinger Hütte, Uslar, Fed. Rep. of Germany

[21] Appl. No.: 811,415

[22] Filed: Dec. 20, 1985

[30] Foreign Application Priority Data

Dec. 21, 1984 [DE] Fed. Rep. of Germany ..... 3446721

[51] Int. Cl.[4] ..... B23P 6/00

[52] U.S. Cl. ..... 29/402.08; 29/426.4; 29/428

[58] Field of Search ..... 29/148.4 A, 402.01, 29/402.03, 402.08, 426.1, 426.4, 428; 14/75, 76, 77

[56] References Cited

U.S. PATENT DOCUMENTS

| | | | |
|---|---|---|---|
| 1,962,820 | 6/1934 | Knight | 29/402.08 |
| 3,979,787 | 9/1976 | Ahlgren | 14/75 |
| 4,356,581 | 11/1982 | Zur | 14/75 |

*Primary Examiner*—Howard N. Goldberg
*Assistant Examiner*—Irene Graves Golabi
*Attorney, Agent, or Firm*—Oblon, Fisher, Spivak, McClelland & Maier

[57] ABSTRACT

The process is used for replacing bridge bearings between pier and superstructure, by the superstructure being lifted relative to the pier (1) by lifting cylinders (8) and the bridge bearing, made thus accessible, being totally or partially replaced. Parts of the old bridge bearing are removed from over the pier contact surface (2) and thus mounting surfaces (12) for lifting cylinders (8) are created under longitudinal web (5) and/or cross-beam (6) of the superstructure on the pier contact surface. Removal of the old bearing parts takes place in such a way, and mounting of lifting cylinders (8) on mounting surfaces (12) is performed so that, after lifting of the superstructure not only are the remaining parts of the old bearing, which are to be replaced, removed by the corresponding new bearing parts installed between lifting cylinders (8).

8 Claims, 2 Drawing Figures

PROCESS FOR REPLACING BRIDGE BEARINGS

The invention relates to a process for replacing bridge bearings between piers and superstructure on bridge structures by the superstructure being lifted relative to the piers by lifting cylinders and the bridge bearing, made thus accessible, is totally or partially replaced and then lowering of the superstructure takes place. By the concept of bridge bearings are understood all types of bearings, especially slide bearings, slide articulated bearings, etc.

BACKGROUND OF THE RELATED ART

It is unavoidable that during the life of the bridge structures, especially those that are exposed to the commensurate traffic load, damages occur in the area of the bearings between the pier and the superstructure. These damages can manifest themselves in various ways. For example, the PTFE (polytetrafluoroethylene) disks of the slide bearings can be squeezed out or breaks can occur in roller bearings. In such cases of damage at least parts of the bearing must be replaced. For this purpose, it is necessary, at times even under full traffic load, to lift the superstructure at certain points on the individual bearing over the corresponding pier, to remove the damaged bearing or the corresponding bearing parts and replace them with new bearing parts or a completely new bearing. Lifting of the superstructure over a pier takes place by use of hydraulic lifting cylinders, which must be mounted so that the forces necessary for lifting the superstructure are introduced, on the one hand, into the superstructure and, on the other hand, into the pier, and to be able to be absorbed by these parts without danger of destruction. The lifting cylinders must be placed relative to the superstructure so that they are under the longitudinal web and under the crossbeam. This generally presents no difficulties, since the longitudinal beam and crossbeam in each case project out farther relative to a pier, so that a point of application for lifting the superstructure can easily be found. However, as a mounting surface for the lifting cylinders the pier contact surface presents difficulties, especially if a bearing of a large contour, relative to the pier contact surface, must be repaired. Then it is often not possible to place on the pier contact surface all the lifting cylinders required to lift the superstructure in the area of a pier. In such a case, there is nothing left to do but to mount on the pier a very expensive cantilever in the area of the pier contact surface, as it were, to enlarge the pier contact surface and to place the lifting cylinders here. Use of such cantilevers is very expensive and requires long assembly times, since a major part of the forces required for lifting the superstructure must be introduced in the pier by the cantilever. Known replacement by use of such cantilevers is particulary difficult on high piers and in some cases can hardly be performed or only at immense cost. In some cases of use, it would indeed be possible to place the lifting cylinders for lifting the superstructure to the pier contact surface, but then these lifting cylinders are so close to one another that removal of the parts of the old bearing, especially of the slide plate is not possible, since the distance between the lifting cylinders is smaller than the width of the slide plate.

SUMMARY OF THE INVENTION

The object of the invention is to show a process of the type initially described, with which it is possible to replace defective bearings or bearing parts on existing bridge structures, without an expensive cantilever construction for mounting of the lifting cylinders being necessary.

This is achieved according to the invention by the fact that parts of the old bridge bearing are removed from over the pier contact surface and thus mounting surfaces for the lifting cylinders are created under the longitudinal web and/or the crossbeam of the superstructure on the pier contact surface and removal of the old bearing parts takes place in such a way and the lifting cylinders are mounted on the mounting surfaces so that, after lifting of the superstructure not only are the remaining parts of the old bearing, which are to be replaced, removed but the corresponding new bearing parts inserted between the lifting cylinders. The invention is based on the finding that with existing structures, which have already been subjected to the traffic load and in which repair occur, the movement phenomena from pretension, creep and contraction of the concrete superstructure no longer are present, but only the effects of temperature and the traffic load must be absorbed. Hence a comparatively smaller play of movement of the bridge results, so that it is possible to install new bearing parts or bearings that are designed smaller in their dimensions than the original old bearings, which must be installed in the production of the structure. Consequently, the invention takes advantage of the thus reduced movement play of the bridge. But in addition such parts of the old bridge bearing, especially the parts of the slide plate, which after mounting of the lifting cylinders would interfere with or make removal of the corresponding bearing part impossible, must be removed, in other words, cut off, cut out, severed or otherwise taken away before mounting of the lifting cylinders. Then it becomes possible to mount the lifting cylinders on the pier contact surface and on the individual mounting surfaces thus created, to lift the superstructure and to remove the remaining parts of the bearing that are to be replaced. In this case, e.g., the cross section of the slide plate is designed so that, on the one hand, the required pier contact surface results and, on the other hand, the rest of the slide plate is so small that it can be removed between two lifting cylinders.

Finally, it is also considered with this cross section that the new, smaller bearing parts can be installed. The process according to the invention opens in a surprising way a very simple and cost-favorable repair possibility for removal of damage to bridge bearings. A cantilever often weighing several tons does not have to be produced or mounted or dismounted.

If often happens that new bearing parts with smaller dimensions than the old bearing parts are used. This feature of the process is used particularly if the slide plate must be replaced, which usually represents the largest part of the bearing.

Removal of the parts of the old bearing can take place by cutting off or cutting out the parts of the slide plate and of the old bearing, especially by a thermal cutting process. In this connection, care should be taken that the anchor plates in the concrete of the superstructure or the concrete itself undergoes as small a heating action as possible and especially that they are not damaged.

The pier contact surface is generally enclosed by a simple clamping ring which a pretension is applied to the pier head before the lifting cylinders are acted on to lift the superstructure.

BRIEF DESCRIPTION OF THE DRAWINGS

The invention is further described by an embodiment. There are shown in:

FIG. 1 shows a top view of a pier 1 with circular cross section, which in the area of its upper pier contact surface 2 is enclosed by a clamping ring 3 which serves to absorb splitting forces. Clamping ring 3 extends a certain height (FIG. 2) on pier head 4.

Figure 1:
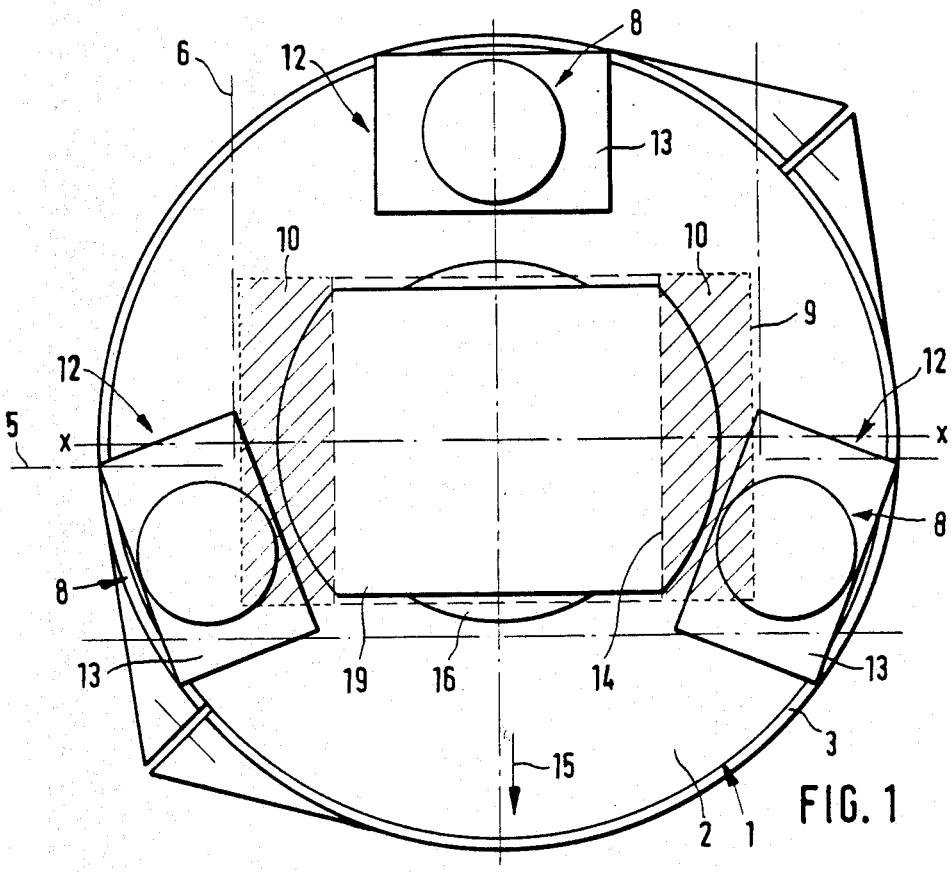
FIG. 1, a diagrammatic top view of a pier with the parts essential for the invention, and FIG. 2, a side view in the area of a pier head.

The superstructure 7 is indicated diagrammatically in projection in FIG. 1 by broken lines, and to be more precise, longitudinal web 5, which extends parallel to the longitudinal axis of the bridge, as well as crossweb 6, which is provided crosswise in the area of the hollow box of superstructure 7. It is necessary to place lifting cylinders 8 in sufficient number, relative to longitudinal web 5 and crossweb 6 of superstructure 7, so that the forces are introduced into these parts of superstructure 7. Lifting cylinders 8 must therefore be placed under longitudinal web 5 and crossweb 6.

Figure 2:
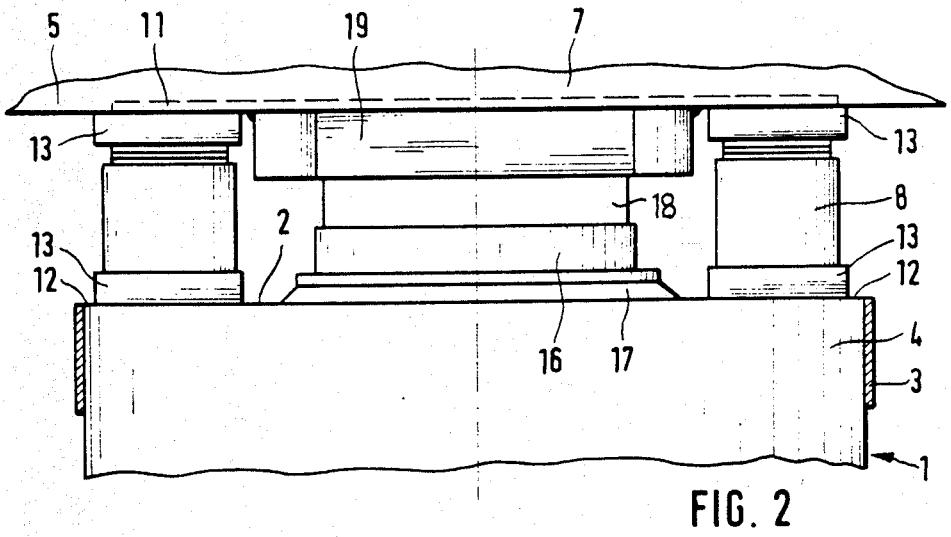

Of the old bearing that is to be replaced, FIG. 1 indicates only the outline of old slide plate 9, by dotted border. Of this old slide plate 9 parts 10 which are indicated by hatching, are cut off by thermal cutting before lifting cylinders 8 are mounted leaving remainder 14. In removing these parts 10, care must be taken that an anchor plate 11 (FIG. 2), embedded, for example, in superstructure 7, and the concrete of superstructure 7, be stressed as little at possible in regard to temperature. By removal of parts 10, mounting surfaces 12 are created in such size and arrangement that lifting cylinders 8, mounted with load-distributing plates 13, can be positioned so that superstructure 7 can be lifted the necessary amount by the action of lifting cylinders 8. Parts of the old bearing and subsequently also the remainder 14 of slide plate 9 can be removed, for example, in the direction of arrow 15. In this case, depending on the case of application, it is not absolutely necessary to remove all parts of the old bearing. Thus, e.g., a bearing base 16 of the old bearing with its mortar joint 17 can remain. Only the parts of the new bearing that are to be replaced, e.g., a bearing seat 18, which contains the bearing lower part and a new slide plate 19, which can be seen by continuous lines in FIG. 1 and further in the view in FIG. 2, need be removed. New slide plate 19 has rounded end areas and allows a reduced movement play which, however, is sufficient for the cases of application. New bearing plate 19 is inserted between lifting cylinders 8 and rotated into the corresponding position. It can be welded onto anchor plate 11. Lifting cylinders 8 and clamping ring 3 are then removed so that repair of the bridge bearing in question is thus completed.

What is claimed is:

1. A process for replacing bridge bearings between a bridge superstructure and supporting piers therefor, said process comprising the steps of:

removing parts of an existing bridge bearing from over a pier contact surface such that multiple mounting surfaces for lifting cylinders are created on said pier contact surface at a position under said superstructure; and around the remainder of the bearing positioning multiple lifting cylinders on portions of said pier contact surface including said multiple mounting surfaces;

raising said bridge superstructure via said lifting cylinders;

removing additional parts of said existing bearing; and introducing new bearing parts between said lifting cylinders.

2. The process of claim 1, wherein said pier contacting surface is radially clamped with a clamping ring.

3. The process of claim 1, wherein said removing step comprises the step of cutting away parts of an existing bearing slide plate.

4. The process of claim 3, wherein said cutting step comprises thermal cutting.

5. The process of claim 1, wherein at least some of said new bearing parts are smaller than corresponding ones of said existing bearing parts.

6. The process of claim 5, wherein said process is carried out for supporting piers having a small contact surface size relative to a size of said bearing.

7. The process of claim 5, wherein said removing step comprises the step of cutting away parts of an existing bearing slide plate.

8. The process of claim 7, wherein said process is carried out for supporting piers having a small contact surface size relative to a size of said bearing.

* * * * *